United States Patent [19]

Pfankuch

[11] Patent Number: 4,563,860

[45] Date of Patent: Jan. 14, 1986

[54] METHOD AND APPARATUS FOR ENVELOPING ARTICLES WITH A PLASTIC FOIL OR THE LIKE

[76] Inventor: Claus K. Pfankuch, Käthnerort 19a, D-2000 Hamburg 76, Fed. Rep. of Germany

[21] Appl. No.: 558,859

[22] Filed: Dec. 7, 1983

[30] Foreign Application Priority Data

Dec. 7, 1982 [DE] Fed. Rep. of Germany ..... 3245156

[51] Int. Cl.[4] ..... B65B 9/02; B65B 51/10; B65B 61/10

[52] U.S. Cl. ..... 53/450; 53/373; 53/555; 156/515

[58] Field of Search ..... 53/329, 371, 373, 548, 53/550, 553, 555, 450; 156/515, 583.1, 583.4

[56] References Cited

U.S. PATENT DOCUMENTS

| | | | |
|---|---|---|---|
| 3,339,337 | 9/1967 | Rapp et al. | 53/562 |
| 3,511,024 | 5/1970 | Manspeaker et al. | 53/550 |
| 3,758,366 | 9/1973 | Ballestrazzi et al. | 156/515 |
| 4,008,554 | 12/1977 | Hardy | 53/555 X |
| 4,019,307 | 4/1977 | Ballestrazzi et al. | 53/553 |
| 4,460,431 | 7/1984 | Keller et al. | 156/515 |

*Primary Examiner*—Robert L. Spruill
*Assistant Examiner*—Michael D. Folkerts
*Attorney, Agent, or Firm*—Staas & Halsey

[57] ABSTRACT

An apparatus for enveloping and packaging widely varying articles has a conveyor belt, to whose starting area are preferably supplied two foil webs, between which foils are located the articles to be packaged. Both between the articles and laterally, welds are produced by welding members, which are arranged on a three-dimensional frame. The frame with the welding members can be moved up and down by a first crank drive (eccentric disk), in order to bring about the actual welding, which welding not only ensures the formation of a joint, but also constitutes a separation weld. The welding members are connected to the three-dimensional frame by a slide, which can be moved backwards and forwards in the conveyor feed direction and, in opposition to the feed direction of the conveyor belt on the frame, by a second crank drive (essentially formed by a crank web, a link and a connecting rod). This latter movement ensures a synchronous movement of the welding members with the foils and articles during the welding process. The two crank drives are jointly driven and the conveyor belt moves somewhat faster than the speed at which the foils are supplied, in order to further increase the separation of the individual packs produced by the separation weld. The apparatus operates continuously, i.e. without interruption, there being no stopping of the conveyor belt during welding.

7 Claims, 3 Drawing Figures

METHOD AND APPARATUS FOR ENVELOPING ARTICLES WITH A PLASTIC FOIL OR THE LIKE

BACKGROUND OF THE INVENTION

The invention relates to an apparatus for enveloping articles with a plastic foil, sheet or film, with a conveyor belt, which moves the enveloped articles up to and away from a welding device which can be moved up and down and which has a transverse welding member and at least one longitudinal welding member.

In a known apparatus of the aforementioned type, normally two foil webs are removed from two corresponding storage reels and are supplied to the welding device. Articles to be enveloped or packaged are introduced into the space between the two foils. Instead of using two foils, it is also possible to use a single foil, which is correspondingly deflected and folded. It is then necessary to laterally weld the foils (on one side only when the foil is folded) and between the articles. Thus, the term "foil" is understood to mean both a folded foil and two separate foils supplied in superimposed manner.

The welding process is preferably a separation welding process, so that the enveloped and packaged articles can be moved out of the apparatus for further treatment in the form of individual packs. The welding operation is carried out by welding members, which are pressed onto the foil from above. Corresponding abutments are provided below the foil. In a known apparatus of the aforementioned type, the feed process is interrupted during welding, i.e. the operation is intermittent, so as to obviate the need for moving the welding members with the foil and the articles during the short welding process.

An apparatus is known for processing and welding plastic foil hose portions, which have been previously cut to size and which are to be made into sacks or bags. For this purpose, the hose portions are fed to a welding device on a table, at right angles to their longitudinal axis, i.e. with their openings positioned laterally. The welding device is provided with transverse welding members, which are moved down onto the hose portions in order to produce a weld, but not a separation weld. Thus, during this welding process, the hose pieces are advanced to the next processing station on the table plate, the next processing station once again being a welding device for completing the welds. The drive and movement of the transverse welding members takes place with the aid of crank drives, positioned below the table plate. There is no conveyor belt. In addition, articles are not enveloped and instead only welds are produced, which welds do not simultaneously ensure a separation (West German publication Offenlengungsschrift No. 1,454,999).

SUMMARY OF THE INVENTION

The object of the invention is to provide an apparatus of the aforementioned type, which operates continuously, but still permits a reliable separation of the enveloped, welded articles.

According to the invention, this object is achieved in that the welding members are mounted on a slide, which can be advanced and retracted with respect to the feed direction; the slide is guided on a frame passing round the conveyor belt; the frame is movable up and down by a first crank drive; and for separating the enveloped, welded articles, the conveyor belt is driven at a speed, which is somewhat higher than the speed with which the foil is supplied.

As a result of the arrangement of the welding members on a slide or carriage, it is possible to move with the conveyor belt and with the foil or foils and articles during the welding process not only the transverse welding beams, but also the longitudinal welding beams, so as to prevent any relative movement between these parts. The foil and articles are conveyed by the conveyor belt and the welding members also perform this movement, so that there is no need to interrupt the feed movement. The movement of the slide, namely both the up and down movement and the forward and backward movement, is preferably brought about by crank drives, positioned below the conveyor belt and which have a common drive means. The latter is then synchronized with the conveyor belt drive. Due to the fact that the conveyor belt moves somewhat faster than the feed speed of the foil, a slip exists between the conveyor belt and the foil until the separation weld has been completed, i.e. for as long as separation has not taken place, so that the conveyor belt is drawn out slightly below the foil and the articles located between it. Only when welding permits separation are the then isolated packs moved away from one another and conveyed out of the installation at the speed of the conveyor belt. The slightly higher speed of the conveyor belt ensures that the physical separation effected by the transverse welding members is increased and is completely ensured. The marginal strips produced by the transverse welding member or members and which constitute waste can be removed by suction.

Due to the fact that the second crank drive is provided with a link permitting an adjustment of the stroke, it is in particular possible to adjust the spacing between the transverse welding members, thereby permitting matching to the conveyor belt speed. The transverse welding member adjustment permits adaptation to different dimensions of the articles to be enveloped.

Advantageously, the conveyor belt passes over an abutment plate made from a mineral material, for example glass, which permits an easy movement of the conveyor belt relative thereto, has a smooth and very flat surface and forms a good, firm and inflexible abutment for the welding members.

BRIEF DESCRIPTION OF THE DRAWINGS

The invention is described in greater detail hereinafter relative to non-limitative embodiments and the attached drawings, wherein.

DETAILED DESCRIPTION OF THE PREFERRED EMBODIMENTS

Figure 1:
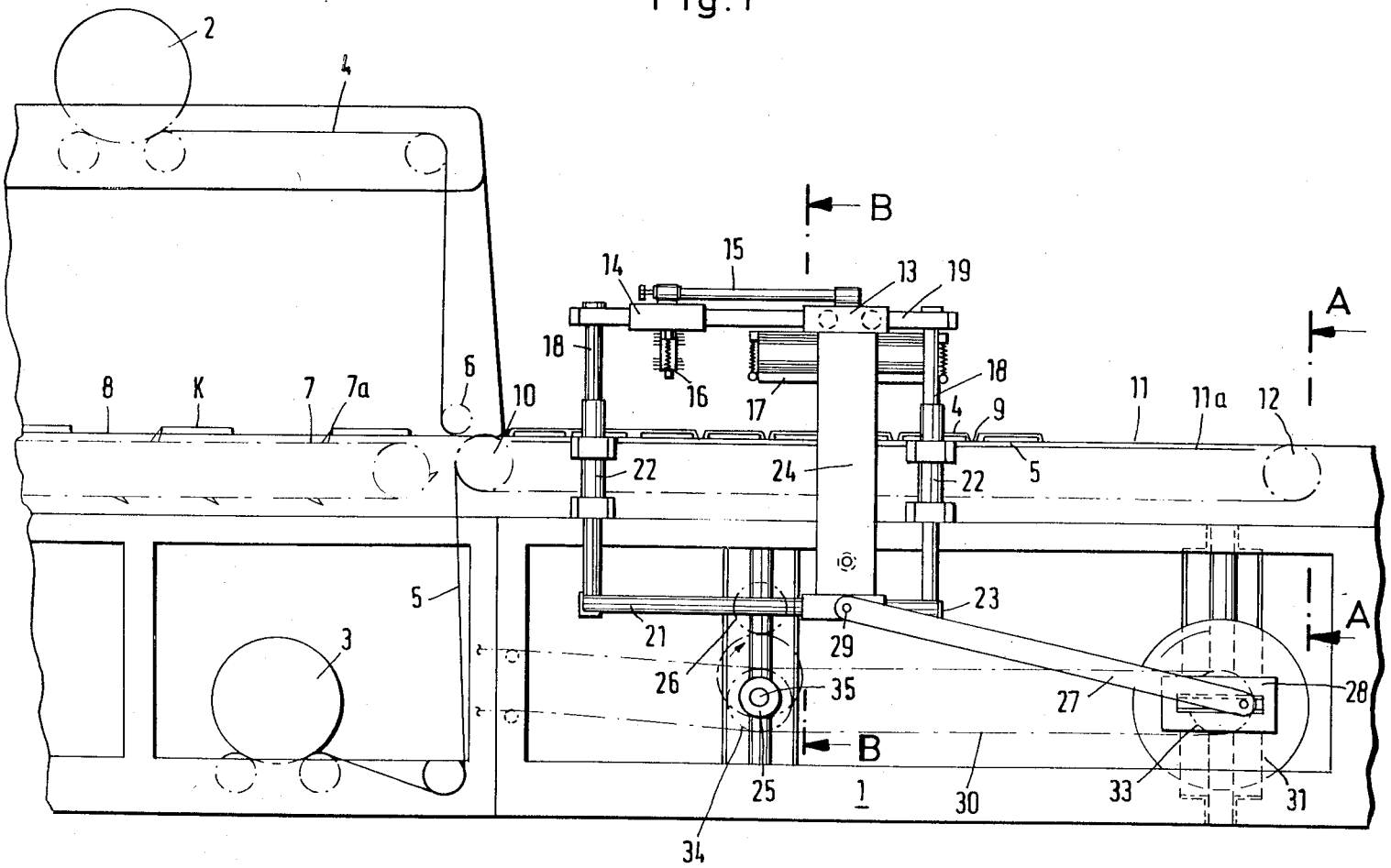
FIG. 1 is a diagrammatic side view of an embodiment according to the invention.

The apparatus shown in the drawing has a machine frame 1, on which are provided corresponding receptacles and bearings for two storage reels 2, 3 for foils 4, 5. The foils are fed by means of guide pulleys 6 and 10 into the area in which terminates a feed conveyor 7 with pivotable dogs 7*a*. With the aid of the latter, conveyor 7 is used for supplying the articles K to be packaged and which are introduced into the space between the two foils. The articles are located on guide rails 8, between which act the dogs 7*a*. After leaving the area of the guide rails, the dogs 7*a* are pivoted back.

The lower foil 5 is fed from below around the guide pulley 10 of an endless conveyor belt 11, whereas the upper foil 4 is supplied from above around the guide pulley 6. Conveyor belt 11 moves somewhat faster than foils 4 and 5, so that until welding has taken place, there is a slight slip, i.e., a relative movement between conveyor belt 11 and foils 4, 5.

The welding device comprises a transverse welding member 16 and two longitudinal welding members 17. The transverse welding member 16 produces transverse welds 9, whilst the longitudinal welding members 17 produce continuous, lateral welds. These welds are separation welds, i.e. welds which are separated and which are different from welding together the two engaging foils. Due to the fact that conveyor belt 11 moves somewhat faster than the foils, this separation produced during welding is increased and is completely ensured. After complete separation has taken place, the packaged articles move at the speed of conveyor belt 11. The laterally obtained marginal strips can be removed by suction means (not shown).

The welding members 16 and 17 are arranged on a slide or carriage, which comprises cross braces 13, 14 interconnected by a spindle 15 and adjustable relative to one another. The cross braces 14, 13 are displaceable on longitudinal rods 19 by means of ball guides in the direction of the movement of conveyor belt 11 and in the direction opposite thereto. The upper longitudinal rods 19, together with posts 18, transverse rods 20, lower longitudinal rods 21 and cross connections 23 form a three-dimensional frame. The latter is guided on posts 18 with guides 22 and can consequently be moved up and down.

Figure 3:
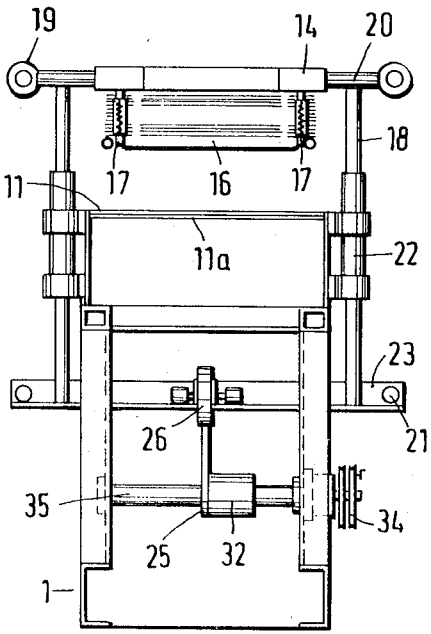
FIG. 3 a sectional view of the apparatus taken along line B—B of FIG. 1.

The frame is moved up and down by means of a crank or eccentric drive with an eccentric disk 25, on which rests an eccentric disk follower 26, pivotably mounted on the cross connection 23. By means of a boss 32, eccentric disk 25 is fixed to a shaft 35, which is mounted in machine frame 1. Shaft 35 is provided with two sprockets, as can best be seen from FIG. 3.

A second crank drive, which comprises a crank web 31 and a connecting rod 27, ensures the reciprocating movement of the slide, which is essentially formed by cross braces 13 and 14. Connecting rod 27 is displaceable in a link 28 of crank web 31 for adjusting the stroke. As can more particularly be seen from FIG. 2, the connecting rod is in two parts in the represented embodiment, i.e. each of the two parts of the connecting rod is offset to one side and is connected at 29 to a corresponding vertical strut 24, which is in turn fixed at the top to the cross brace 13. The vertical struts 24 are essentially part of the slide and can be reciprocated on longitudinal rods 19 and 21.

Through the adjustment of the stroke with the aid of link 28, adaptation to the speed of the conveyor belt and consequently to the size of the articles to be enveloped is possible. A further adjustment possibility is provided by spindle 15, which enables the transverse welding member 16 to be adjusted relative to the longitudinal welding member 17.

Both the crank drives are driven by means of chains 30, which pass over sprockets 34 and a sprocket 33, mounted on shaft 36, which carries the crank web 31.

Figure 2:
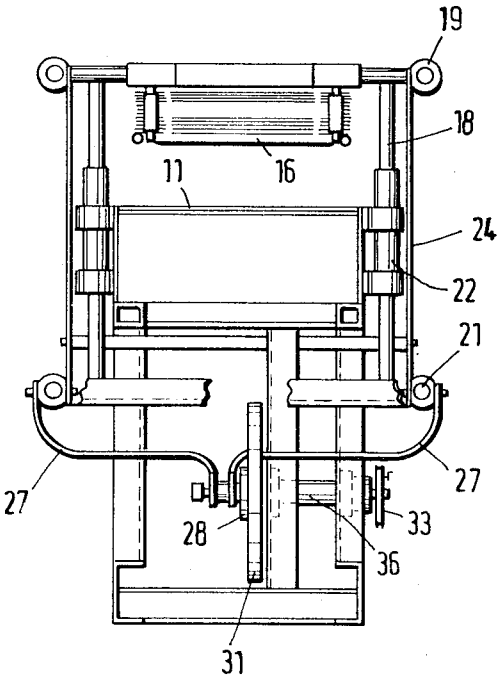
FIG. 2 is a sectional view of the apparatus taken along line A—A of FIG. 1.

In another embodiment, the crank drives, i.e. eccentric disk 25 and crank web 31, can be arranged on one shaft, e.g. on shaft 35. In this case, the connecting rod is shorter and there is no need to subdivide the same into two laterally offset parts, as shown in FIG. 2.

The upper strand of conveyor belt 11 passes over a plate 11*a* made from a mineral material, preferably glass. This not only permits easy movement, but simultaneously provides a good and stable abutment for the welding members during the welding process.

In operation, the two foils 4 and 5 are supplied from reels 2 and 3 in such a way that the articles K are located between them. When welding is to be carried out, the complete three-dimensional frame carrying the welding device is moved downwards in guides 22 by the first crank drive. The eccentric disk 25 of the first crank drive assumes its highest position in FIG. 3. Following a corresponding rotation of shaft 35, the eccentric disk follower 26 follows the eccentric disk 25, as a result of its own weight. The setting of the second crank drive by link 28 is carried out in such a way that, when welding members 16, 17 reach the foils and carry out electrical resistance welding, the slide with the welding beam is moved synchronously with the foils and articles. When welding is ended, the first crank drives ensures that the welding beams with the complete frame are again moved upwards. Simultaneously, the slide is moved back to its initial position by the second crank drive and the next welding operation can commence.

Due to the fact that conveyor belt 11 moves somewhat faster than the speed at which foils 4 and 5 are supplied, the separation produced by the welding process is somewhat increased. The articles are then moved out of the installation at the speed of conveyor belt 11.

Due to the joint drive of the two crank drives and the easy adjustment, it is possible to obtain a very precise setting of the two movements, i.e. the downwardly directed movement of the welding members and the movement with the foils to be welded. It is also possible to easily adapt to different sizes.

It is also possible to operate with one foil, which is then supplied from below and folded round the articles to be enveloped. In this case, longitudinal welding on only one side is required, so that there is no need for a second longitudinal welding member 17.

What is claimed is:

1. A method for enveloping articles with a plastic foil, and welding and separating the enveloped articles, the method comprising the steps of:

(a) enveloping the articles by supplying foil to articles on a continuously moving conveyor belt, the conveyor belt being driven at a speed higher than the speed with which the foil is supplied thereto;

(b) longitudinally and transversely welding the enveloped articles during continuous movement of the articles along the conveyor belt using (i) a welding device moveable up and down and forward and backwards in relationship to the enveloped articles continuously moving along the conveyor belt and having a transverse welding member and a longitudinal welding member; (iii) a slide for mounting the welding members, the slide being moveable forwards and backwards in relationship to the enveloped articles continuously moving along the conveyor belt; and (iii) a frame for slidably mounting the slide thereon, the frame being moveable up and down in relationship to the enveloped articles continuously moving along the conveyor belt; and (c) separating the enveloped, welded articles by the longitudinal and transverse welding and the speed of the conveyor belt being higher than the speed with which the foil is supplied thereto.

2. An apparatus for enveloping articles with a plastic foil comprising:

(a) conveyor belt means for continuously moving enveloped articles, including means for driving said conveyor belt means at a speed higher than the speed with which the foil is supplied thereto;

(b) a welding device moveable up and down and forward and backwards in relationship to the enveloped articles continuously moving along said conveyor belt means and having a transverse welding member and a longitudinal welding member;

(c) a slide for mounting said welding members thereon, said slide moveable forwards and backwards in relationship to the enveloped articles continuously moving along said conveyor belt means;

(d) a frame for slidably mounting said slide thereon, said frame moveable up and down in relationship to the enveloped articles continuously moving along said conveyor belt means; and (e) a first crank drive for moving said frame up and down; whereby the enveloped, welded articles are separated by the higher speed of the conveyor belt means than the speed at which the foil is supplied thereto.

3. An apparatus according to claim 2, further comprising a second crank drive for moving the slide backwards and forwards and a common drive for the first and second crank drives.

4. An apparatus according to claim 3, wherein the second crank drive has a link for adjusting the stroke of the slide movement produced by the second crank drive.

5. An apparatus according to claim 3, wherein the first and second crank drives are arranged below the conveyor belt.

6. An apparatus according to claim 2, wherein the transverse welding member is adjustable in the conveyor feed direction.

7. An apparatus according to claim 2, further comprising an abutment plate in the vicinity of the welding members on which the conveyor belt runs.

* * * * *